US005396408A

United States Patent [19]

Szczech, III

[11] Patent Number: 5,396,408

[45] Date of Patent: Mar. 7, 1995

[54] DETACHABLE WINDOW DECORATION

[76] Inventor: John J. Szczech, III, 7469 S. Tamarac Ct., Englewood, Colo. 80112

[21] Appl. No.: 176,840

[22] Filed: Jan. 3, 1994

[51] Int. Cl.[6] ..... F21V 21/08

[52] U.S. Cl. ..... 362/397; 362/806; 362/80.1; 248/206.5; 248/206.3; 248/206.4

[58] Field of Search ..... 362/125, 806, 397, 80.1, 362/351; 40/597, 564; 248/205.5, 206.3, 206.4

[56] References Cited

U.S. PATENT DOCUMENTS

| | | | |
|---|---|---|---|
| 1,856,519 | 5/1932 | Spears | 40/597 X |
| 2,675,983 | 4/1954 | King | 362/397 X |
| 3,840,732 | 10/1974 | Cohen | 40/564 |
| 4,185,407 | 1/1980 | Lamb | 40/564 X |
| 4,556,932 | 12/1985 | Lehrer et al. | 362/806 X |
| 4,860,476 | 8/1989 | Hall | 40/597 X |
| 5,237,764 | 8/1993 | Gray | 248/206.4 X |

*Primary Examiner*—Ira S. Lazarus
*Assistant Examiner*—Thomas M. Sember
*Attorney, Agent, or Firm*—Michael I. Kroll

[57] ABSTRACT

A detachable window ornament that includes a plurality of light sources inside a plenum formed from an opaque rear wall, a continuous side wall extending about it, and a front, translucent panel. Attached to the side walls are a number of suction cups that allow the device to be removably attached to the window. The front panel can carry a variety of different ornamental displays, such as those relating to a specific holiday, or the like. Additionally, it is contemplated that the device could be attached to one of the windows of an automobile.

6 Claims, 3 Drawing Sheets

DETACHABLE WINDOW DECORATION

BACKGROUND OF THE INVENTION

1. Field of the Invention

The present invention relates broadly to the field of decoration and more specifically to illuminated decorations. Even more specifically, it relates to lighted decorations that can be attached to a window surface. In its greatest specificity, the invention relates to a lighted decoration having a light transmissive front panel and an enclosure or plenum containing at least one light source and a power source and that further includes a temporary attachment means for engaging with the window.

2. Description of the Prior Art

During the holidays, or for special occasions, a large number of people enjoy decorating their homes to reflect the spirit of the season, whether it be Christmas, Thanksgiving, Halloween, or the like. These decorations can take the form of multitudes of small lights draped on the home to trace its outline, sheets of fanciful or decorative drawings, figurines placed on the lawn, or the like. A number of issued patents relate to this manner of decorating.

U.S. Pat. No. 4,652,980 issued on Mar. 24, 1987 to Marc H. Segan discloses a music and lights Christmas ball ornament wherein a self powered illuminated ornament includes an acetate shrink wrap covering a portion of its outer surface. In contrast to applicants invention, the suction-cup like attachment means is not shown.

In U.S. Pat. No. 4,836,823 issued on Jun. 6, 1989 to Douglas J. Laven there is disclosed a heart-shaped novelty item that has a translucent window. When the object is held in a user's hand, two LED's flash to simulate the beating of a human heart. As in the Segan patent above, the suction-cups of applicant's invention are not disclosed.

Next is U.S. Pat. No. 4,923,721 issued on May 8, 1990 to William M. Gilmore. This patent discloses a musical ornament having a pair of separate ornamental units connected by a cable. One of the units has a movable portion to provide a decorative effect. The other contains the power source. Though the disclosure mentions integral eye-hooks to allow for the use of conventional Christmas tree hooks in hanging the units, this is clearly dissimilar from applicant's present invention.

Lastly, U.S. Pat. No. 4,965,705 issued on Oct. 23, 1990 to Wen-Tsung Lin discloses a electronic badge having double-effect pins. When the pins are in a first position, power is applied to a flasher circuit, and when the pin is inverted 180 degrees, the flasher circuit is not activated. The single spaced light containing plenum of applicant's present invention is not shown.

None of the above inventions and patents, taken either singly or in combination, is seen to describe the instant invention as claimed.

SUMMARY OF THE INVENTION

The present invention is a detachable window ornament that includes one or more light sources inside a plenum formed from an opaque rear wall, a continuous side wall extending about it, and a front, translucent panel. Attached to the side walls are a number of suction cups that allow the device to be removably attached to a window or other light transmissive surface. The front panel can carry a variety of different ornamental displays, such as those relating to a specific holiday, or the like. Additionally, it is contemplated that the device could be attached to one of the windows of an automobile.

Accordingly, it is a principal object of the invention to provide a detachable window ornament that is simply and easily attached to a window by means of suction cups.

It is another object of the invention to provide a detachable window ornament that is powered by batteries or optionally, can be powered by rechargeable cells that are themselves charged by solar cells.

It is also an object of the invention to provide a means for easily switching the light source on and off to conserve battery power during the day and enhance the display during the hours of darkness.

It is another object of the invention to provide an ornament that is reversible so that it may also be mounted on an opaque surface such as a wall with its light transmissive panel facing outward from the wall.

It is a general goal of the invention to provide improved elements and arrangements thereof in an apparatus for the purposes described which is inexpensive, dependable and fully effective in accomplishing its intended purposes.

It is submitted that the present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
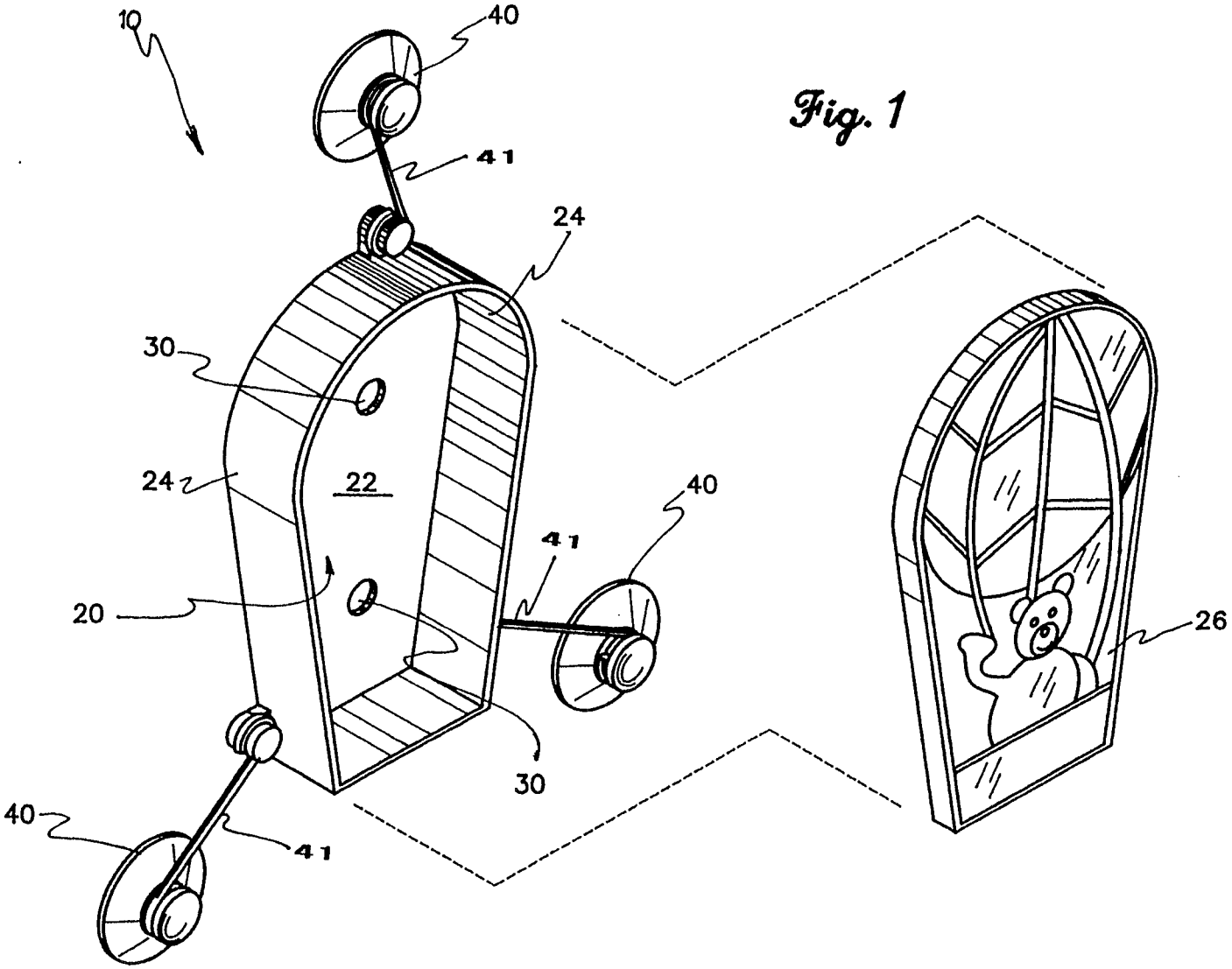
FIG. 1 is an exploded perspective view of the present invention with the light transmissive panel removed for clarity.

The present invention is indicated in the Figures generally at 10. Referring to FIG. 1, there is seen that the light source plenum 20 is formed by a rear wall 22, continuous side walls 24, and the light transmissive front panel 26. The front panel 26 is actually made up of numerous adjacent colored sub panels which are joined together to make up the overall shape of the front panel in the manner of a stained glass window. Within the plenum 20 are mounting holes for two light sources 30. Though two light source locations are shown in this figure, it is obvious that more could be used, or that only one, if desired, could be located within the plenum 20. The surface of rear wall 22 is preferably coated with a light reflective substance, or polished, so as to reflect any misdirected light outwardly through light transmissive front panel 26 and enhance the overall external appearance of brightness. The routinist will recognize many other ways of imparting light reflective properties to the interior of plenum 20. For example, bright plastic inserts (not shown) could be used to line the interior surfaces of plenum 20.

Figure 3:
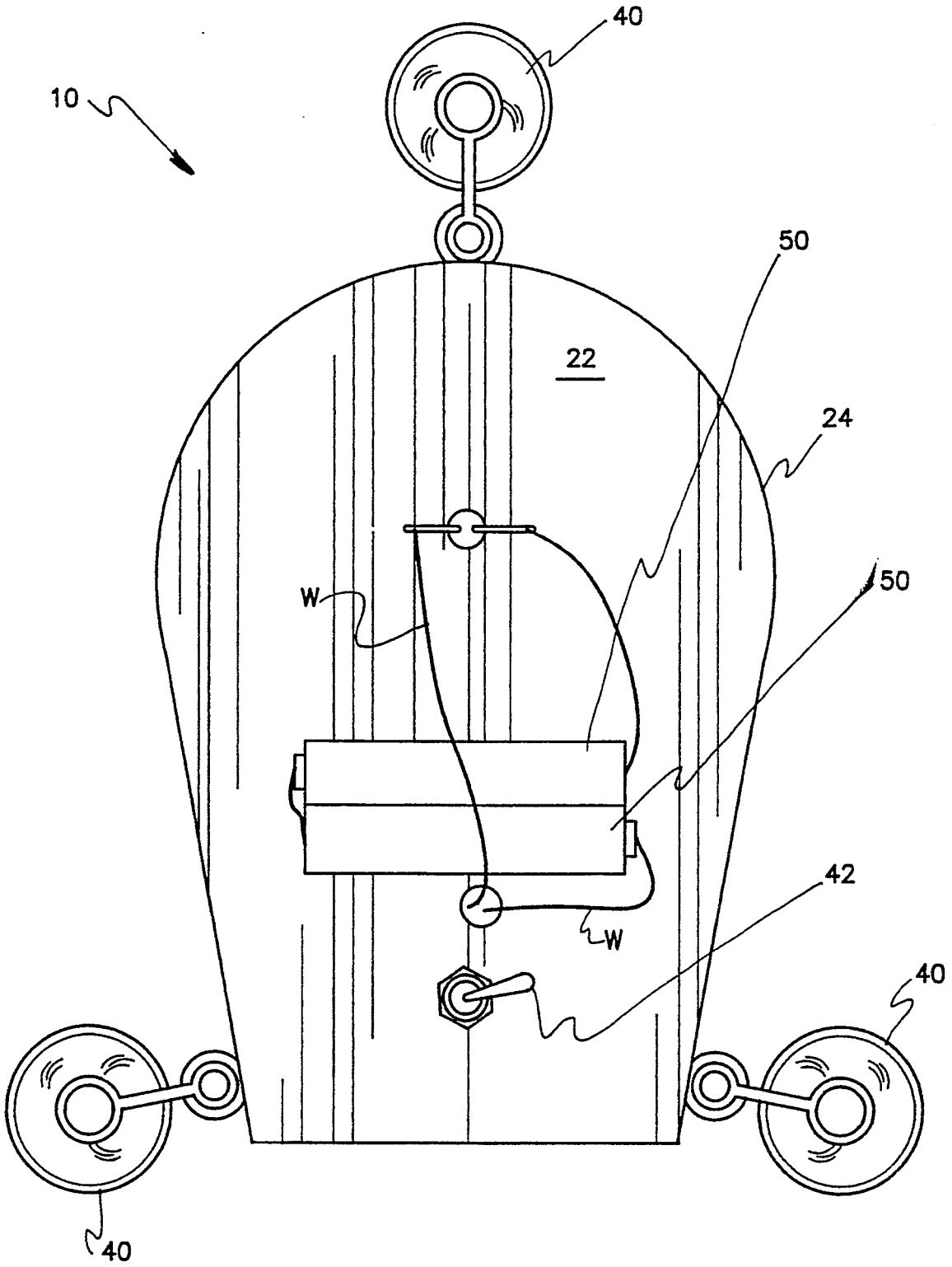
FIG. 3 is a rear view showing the batteries mounted on the rear wall of the light enclosure and the on/off switch.

Located proximate to, and integral with the side wall 24, there are a plurality of suction cups 40, the outer ends of legs 41 mounted on an extending from side wall 24, that allow the device to be attached and detached from a window or opaque surface. If the device were to be attached to the inside of a window, to face outwardly from a home or automobile, the suction cups would be mounted to face the front light transmissive panel as shown in FIG. 3. On the other hand, if it were desired to mount the device on an opaque wall the suction cups 40 could easily be turned so as to face rear wall 22 of plenum 40 as shown in FIG. 1. The suction cup mounting brackets are designed so as to allow for easy reversibility.

Figure 2:
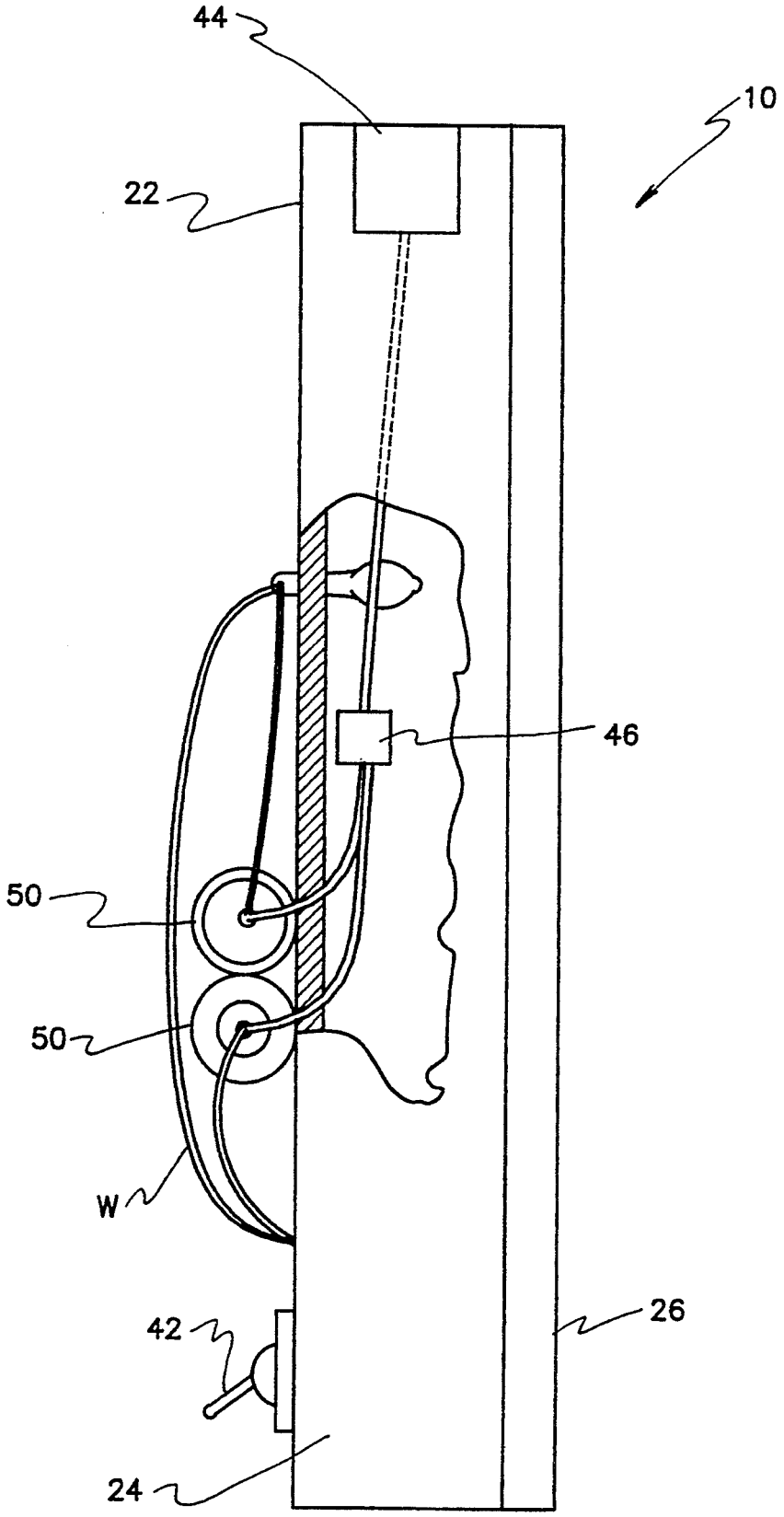
FIG. 2 is a partially cutaway side view showing of the invention with the optional solar panel and trickle charge circuit for recharging the batteries.

Referring now to FIG. 2, a power means for the device is shown. There are two batteries 50, held in relation to the rear wall 22 of the device 10. Although the batteries are shown mounted on the exterior of rear wall 22, the routinist will recognized that the could just as easily be mounted on the interior within the enclosed volume of plenum 20. The batteries could be held in position by any of the many conventional battery clips or holders that are well known in the art. These batteries 50 are connected in series, as can be seen in FIGS. 2 and 3 to the light sources 30 by conventional wires W. One of ordinary skill would easily recognize that a parallel wiring arrangement would be just as feasible. An on/off switch 42 is provided to allow or prevent electrical current to flow through the light sources 30. It is contemplated that, to enhance reversibility, the switch 42 could just as easily be mounted on one of the side panels 24.

An optional alternative power source is shown in FIG. 2. A small solar panel 44 could be provided on a portion of the side wall 24 to recharge the batteries 50. As it is contemplated that the device will have most of its impact during the evening hours, and that it will be in place on the window during the day, a trickle charge circuit 46 could be used to charge up the batteries 50. Additionally, a light sensor (not shown) could be used to automatically turn the device on or off when the daylight level falls below a predetermined value.

It should be noted that the device could have a wide variety of shapes and that the decorative panel 26 could represent any number of festive icons or could even carry indicia, if desired. The particular panel illustrated here is formed from a metallic framework which is sectioned off into several smaller adjacent interior areas by numerous connected interior walls. Each individual interior area is filled with a different colored light transmissive material so as to create the overall effect of a stained glass window.

It is contemplated that the device 10 would be suitable for use on a window of an automobile, providing a whimsical and personalizing touch during travel. For example, the device could be shaped as the home State of the user so as to proclaim to all the origin of the travelers. It should be emphasized that the exact overall shape or decorative appearance of the device is not to be limited by the details shown herein for the purposes of providing an exemplary embodiment of the invention.

Following hereinafter is a list of the elements discussed in this specification:

| | |
|---|---|
| present invention | 10 |
| light source plenum | 20 |
| rear wall | 22 |
| side wall | 24 |
| light transmissive front panel | 26 |
| light sources | 30 |
| suction cups | 40 |
| batteries | 50 |
| wires | W |
| on/off switch | 42 |
| solar panel | 44 |
| trickle charge circuit | 46 |

These variations are taught here in the expectation that the scope of patent protection, limited only by the appended claims, will include such variations.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

I claim:

1. An ornament for the decoration of a substantially smooth surface comprising:

means to define a light source plenum including a rear wall, a continuous side wall, and a decorative light transmissive front panel opposite said rear wall;

light emission means disposed within said plenum;

means to provide power to said light emission means, including an on-off switch; and mounting means capable of either mounting said ornament on an opaque surface with the rear wall of said plenum flush said decorative light transmissive front panel will appear to emanate from said opaque wall and be easily viewed from one side of said opaque surface so that said transmission light panel is visible; or on one side of a transparent surface and holding said decorative light transmissive front panel flush against said transparent surface so that light emitting through said panel will further pass through said transparent surface and be easily viewed from an opposite side of said transparent surface, said mounting means comprising a plurality of outwardly extending legs, each leg having a first end and a second end, said first end being attached to an outer surface of said continuous side wall and said second end being attached to a reversible suction cup; whereby said ornament can be temporarily attached to a smooth surface by means of said suction cups, said on off switch is manipulated to provide electrical power to said light emitting means such that said decorative light transmissive panel is illuminated.

2. The ornament according to claim 1, wherein said light emission means is at least one conventional flashlight bulb.

3. The ornament according to claim 2, wherein said transparent surface is a window.

4. The ornament according to claim 3, wherein said opaque surface is a wall.

5. The ornament according to claim 3, wherein said decorative light transmissive front panel consists of a plurality of differently colored and shaped sub panels fitted together so as to simulate the appearance of a stained glass window on said wall when said light emission means is switched on.

6. The ornament according to claim 5, wherein said light source plenum further includes light reflective means to direct light through said decorative light transmissive front panel and thus enhance the overall apparent brightness of the ornament.

* * * * *